US006886567B1

(12) United States Patent
Liu

(10) Patent No.: US 6,886,567 B1
(45) Date of Patent: May 3, 2005

(54) GLOWING MOUTH GUARD

(75) Inventor: Ker-Chuan Liu, Tainan (TW)

(73) Assignee: Guan Dai Technology Co., Ltd., Tainan Hsien (TW)

( * ) Notice: Subject to any disclaimer, the term of this patent is extended or adjusted under 35 U.S.C. 154(b) by 0 days.

(21) Appl. No.: 10/720,208

(22) Filed: Nov. 25, 2003

(51) Int. Cl.[7] ..... A61C 5/14

(52) U.S. Cl. ..... 128/861; 128/862; 128/848; 602/902; 433/6

(58) Field of Search ..... 128/861, 862, 128/859, 846, 848; 362/34, 84, 253; 433/6, 433/29; 29/896.1, 896.11; 602/902

(56) References Cited

U.S. PATENT DOCUMENTS 2,707,951 A * 5/1955 Hinton ..... 128/861
3,203,417 A * 8/1965 Helmer ..... 128/861
3,247,844 A * 4/1966 Berghash ..... 128/862
3,303,844 A * 2/1967 Johnson et al. ..... 128/862
3,429,045 A * 2/1969 Anderson et al. ..... 433/6
4,791,941 A * 12/1988 Schaefer ..... 128/861
5,031,611 A * 7/1991 Moles ..... 433/6
5,235,991 A * 8/1993 Minneman ..... 128/859
5,816,255 A * 10/1998 Fishman et al. ..... 128/861
6,231,337 B1 * 5/2001 Boyd ..... 433/6
6,299,441 B1 * 10/2001 Novak ..... 433/29

* cited by examiner

*Primary Examiner*—Fadi H. Dahbour
(74) *Attorney, Agent, or Firm*—Rosenberg, Klein & Lee

(57) ABSTRACT

A glowing mouth guard has a transparent main body, and a transparent glow element for insertion in the main body; the glow element has an outer part formed with several separate holding rooms, which contain respective easily-breakable sealed tubes as well as respective first chemicals therein; the sealed tubes contain respective second chemicals therein; one of both of the chemicals in each holding room of the glow element is a catalytic agent, and the other a luminous chemical, which can produce fluorescent glow through a chemical reaction with the help of the catalytic agent when it is mixed with the agent, such that the holding rooms of the glow element have respective ones of several different-colored fluorescent glows shining.

1 Claim, 4 Drawing Sheets

GLOWING MOUTH GUARD

BACKGROUND OF THE INVENTION

1. Field of the Invention

The present invention relates to a glowing mouth guard, more particularly one, which can produce several different-colored fluorescent glows instead of only one to be more attractive.

2. Brief Description of the Prior Art

People would dress, and make them up so as to have fancy look in certain events, e.g. parties, concerts, and Halloween celebrations.

Referring to FIGS. 5 and 6, a glowing mouth guard, which is one of personal ornamental articles that are often found in the above mentioned events, includes a main body 3, and a glow stick 4, both made of transparent materials. The main body 3 has two flexible connecting wing portions 32 on left and right sides, and a holding room 31 in the middle for allowing insertion of the glow stick 4 therein. The glow stick 4 includes an outer shell 41, a first chemical 42 held in the outer shell 41, an inner sealed tube 43 held in the outer shell 41, and a second chemical 44 held in the inner sealed tube 43. The outer shell 41 is flexible and can't crack when it is bent while the inner sealed tube 43 can be easily broken when it is bent. One of the first and the second chemicals 42 and 44 is a catalytic agent, and the other a luminous chemical, which will produce fluorescent glow through a chemical reaction thereof with the help of the catalytic agent when it is mixed with the agent.

To use the glowing mouth guard, the glow stick 4 is first bent so that the inner sealed tube 43 ruptures, and the first and the second chemicals 42 and 44 mix to produce fluorescent glow. Then, the glow stick 4 is inserted in the holding room 31 of the main body 3, and the connecting wing portions 32 of the main body 3 disposed over the user's teeth; because the wing portions 32 are flexible, they will change shape to suit the user, and in turns, the mouth guard can be securely held in the mouth. Consequently, fluorescent glow can be seen from the user's mouth when he/she opens mouth.

However, Having single luminous chemical and single catalytic agent, the glow stick 4 can only produce single-colored fluorescent glow, incapable of satisfying people's desire for difference.

SUMMARY OF THE INVENTION

It is a main object of the present invention to provide a glowing mouth guard to overcome the above disadvantage.

The glowing mouth guard has a transparent main body, and a transparent glow element for insertion in the main body. The glow element has an outer part formed with several separate holding rooms, which contain respective easily-breakable sealed tubes as well as respective first chemicals therein. The sealed tubes contain respective second chemicals therein. One of both of the chemicals in each holding room of the glow element is a catalytic agent, and the other a luminous chemical, which can produce fluorescent glow through a chemical reaction with the help of the catalytic agent when it is mixed with the agent, such that the holding rooms of the glow element have respective ones of several different-colored fluorescent glows shining. In other words, the glowing mouth guard can produce several different-colored fluorescent glows.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
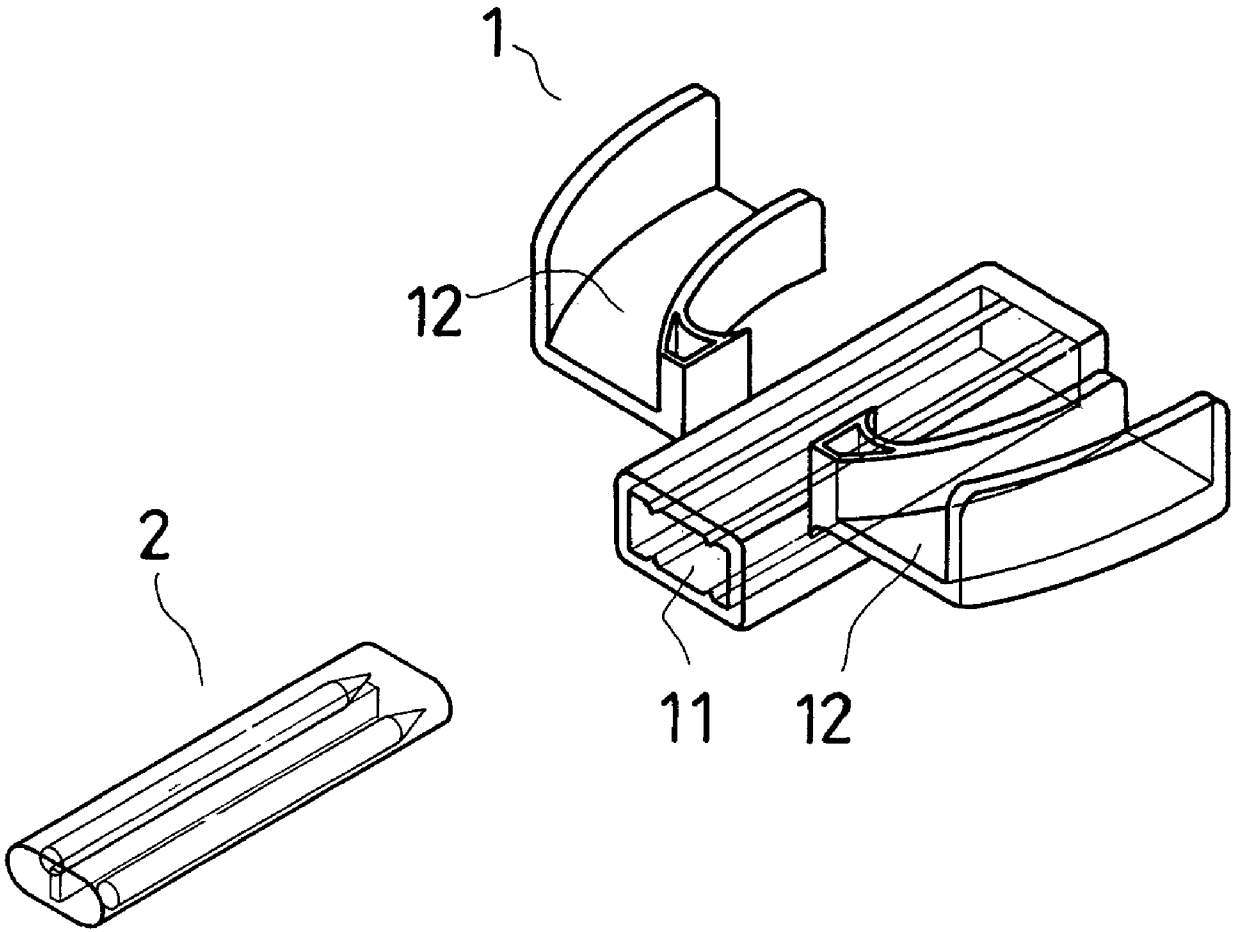
FIG. 1 is an exploded perspective view of the glowing mouth guard according to the present invention.
Figure 2:
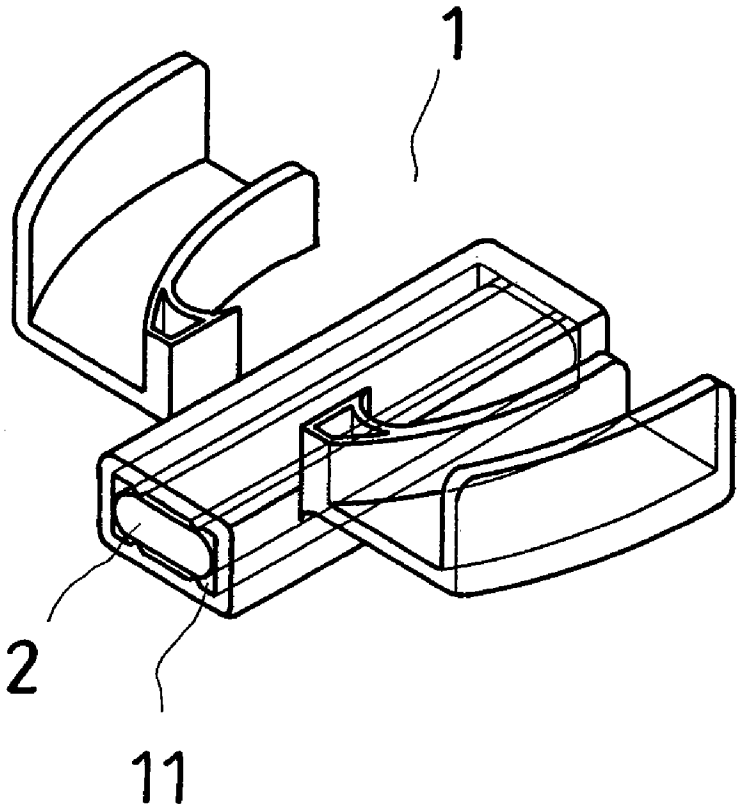
FIG. 2 is a perspective view of the glowing mouth guard according to the present invention.
Figure 3:
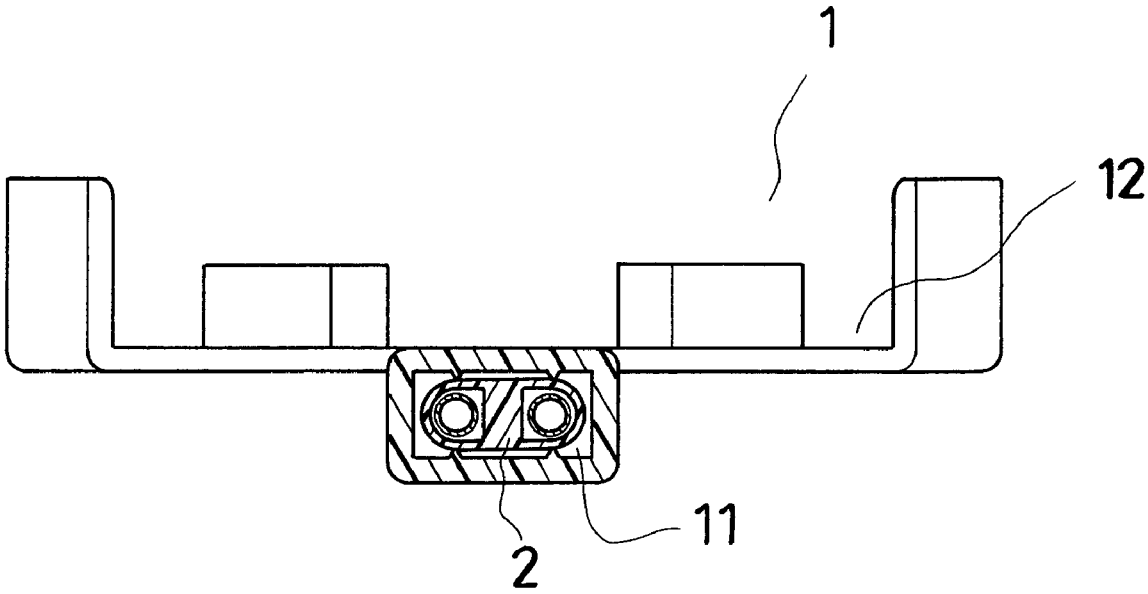
FIG. 3 is a cross-sectional view of the glowing mouth guard according to the present invention.
Figure 4:
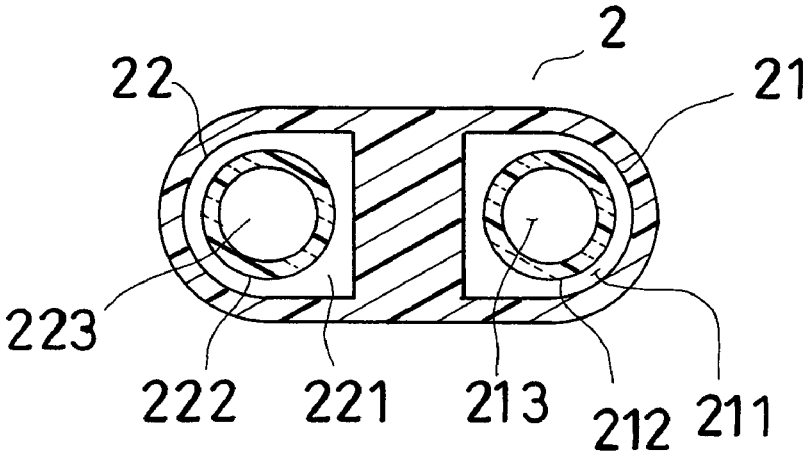
FIG. 4 is a cross-sectional view of the glow stick of the glowing mouth guard of the present invention.
Figure 6:
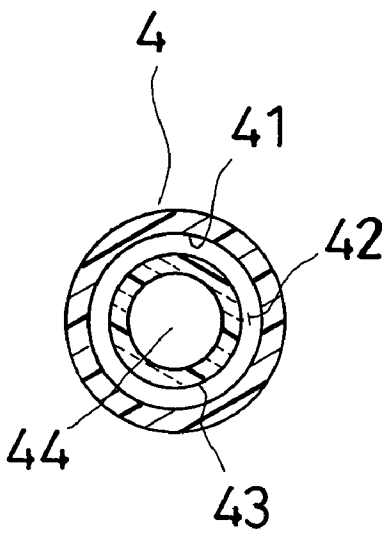
FIG. 6 (PRIOR ART)
FIG. 6 is a cross-sectional view of the glow stick of the conventional glowing mouth guard.
Figure 5:
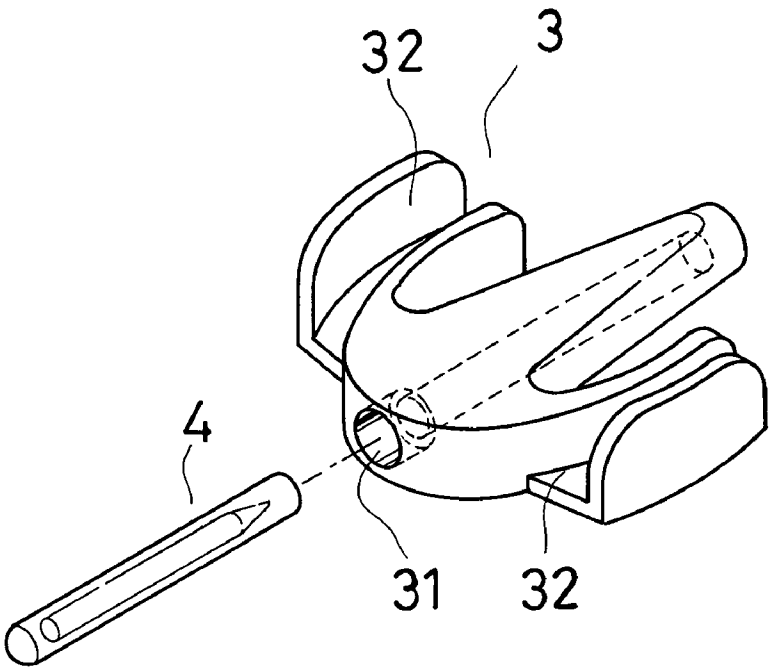
FIG. 5 (PRIOR ART)
FIG. 5 is an exploded perspective view of the conventional glowing mouth guard as described in the Background.

Referring to FIGS. 1 to 3, a preferred embodiment of a glowing mouth guard in the present invention includes a main body 1, and a glow element 2, both of which are made of transparent materials. The main body 1 has two flexible connecting wing portions 12 on left and right sides, and a holding room 11 in the middle for allowing insertion of the glow element 2 therein.

The glow element 2 includes an outer flexible holding part, wherein separate first and second holding rooms 21, 22 are formed, and two inner sealed tubes 212, 222 respectively held in the first and the second holding rooms 21, 22. A first chemical 211 is held in the first holding room 21 of the glow element 2 while a second chemical 213 is held in the inner sealed tube 212. In addition, a first chemical 221 is held in the first holding room 22 of the glow element 2 while a second chemical 223 is held in the inner sealed tube 222. The outer holding part of the glow element 2 is flexible, and can't crack when it is bent while the inner sealed tubes 212, 222 can be easily broken when it is bent. One of the first and the second chemicals 211 and 213 is a catalytic agent, and the other a luminous chemical such as Oxalate Compound, which will produce first fluorescent glow through a chemical reaction with the help of the catalytic agent when it is mixed with the agent. Similarly, one of the first and the second chemicals 221 and 223 is a catalytic agent, and the other a luminous chemical such as Oxalate Compound, which will produce second fluorescent glow when it is mixed with the catalytic agent. The first and the second fluorescent glows have different colors, and can be red, pink, blue, green etc.

To use the glowing mouth guard, the glow element 2 is first bent so that the inner sealed tubes 212, 222 rupture, the chemicals 211 and 213 mix to produce the first fluorescent glow, and the chemicals 221 and 223 mix to produce the second fluorescent glow. Then, the glow element 2 is inserted in the holding room 11 of the main body 1, and the connecting wing portions 12 of the main body 1 are disposed over the user's teeth; because the wing portions 12 are flexible, they will change shape to suit the user, and in turns, the mouth guard can be steadily held in position. Consequently, different-colored fluorescent glows can be seen from the user's mouth when he/she opens mouth.

From the above description, it can be easily understood that the glowing mouth guard of the present invention has advantages as followings:

1. It can produce different-colored fluorescent glows to be more attractive and satisfy consumers' desire for variety.

2. It is as easy and convenient to use as the conventional glowing mouth guard although it is structured so as to produce more colored glows.

What is claimed is:

1. A glowing mouth guard, comprising a transparent main body capable of being steadily held in a user's mouth;

a transparent glow element for insertion in the main body; the glow element having an outer holding part formed with a plurality of separate holding rooms, which contain respective easily-breakable sealed tubes as well as respective first chemicals therein; the sealed tubes containing respective second chemicals therein; one of both of the chemicals in each holding room of the glow element being a catalytic agent, and other one being a luminous chemical, which can produce fluorescent glow through a chemical reaction with help of the catalytic agent when it is mixed with the agent, such that the holding rooms of the glow element have respective ones of a plurality of different-colored fluorescent glows shining.

* * * * *